US011118830B2

(12) United States Patent
McKinnon

(10) Patent No.: US 11,118,830 B2
(45) Date of Patent: Sep. 14, 2021

(54) COOLER SYSTEM

(71) Applicant: Brian Keith McKinnon, Anchorage, AK (US)

(72) Inventor: Brian Keith McKinnon, Anchorage, AK (US)

( * ) Notice: Subject to any disclaimer, the term of this patent is extended or adjusted under 35 U.S.C. 154(b) by 0 days.

(21) Appl. No.: 16/786,048

(22) Filed: Feb. 10, 2020

(65) Prior Publication Data

US 2020/0256607 A1 Aug. 13, 2020

Related U.S. Application Data

(60) Provisional application No. 62/803,429, filed on Feb. 9, 2019.

(51) Int. Cl.

| | |
|---|---|
| ***F25D 3/08*** | (2006.01) |
| ***A47B 5/04*** | (2006.01) |
| ***A47B 3/00*** | (2006.01) |
| ***F25D 23/06*** | (2006.01) |
| ***A47B 5/06*** | (2006.01) |

(52) U.S. Cl.

CPC ..... *F25D 3/08* (2013.01); *A47B 3/002* (2013.01); *A47B 5/04* (2013.01); *A47B 5/06* (2013.01); *F25D 23/065* (2013.01)

(58) Field of Classification Search

CPC . F25D 3/06; F25D 3/08; F25D 23/065; F25D 2300/00; F25D 2323/00; F25D 2323/02; F25D 2323/06; F25D 2400/08; F25D 2400/14; A47B 3/002; A47B 5/04; A47B 5/06; A45C 11/20; B65D 43/16; B65D 43/163; B65D 43/164; Y10S 220/9151; Y10S 220/9152

USPC ..... 220/592.03, 915.1, 915.2, 836, 810

See application file for complete search history.

(56) References Cited

U.S. PATENT DOCUMENTS

| | | | | |
|---|---|---|---|---|
| 3,873,114 | A * | 3/1975 | Brown | B62B 3/02 280/30 |
| 5,457,939 | A | 10/1995 | Bardou | |
| 5,803,472 | A * | 9/1998 | Lien | A45C 5/14 108/129 |
| 5,890,613 | A * | 4/1999 | Williams | A45C 7/0045 220/23.4 |
| 6,176,499 | B1 * | 1/2001 | Conrado | A45C 5/14 280/47.26 |
| 7,331,163 | B2 * | 2/2008 | Hau | B65B 31/046 53/408 |
| 7,669,434 | B2 * | 3/2010 | Leclear | F25D 23/12 62/331 |
| 7,930,892 | B1 | 4/2011 | Vonderhaard | |

(Continued)

*Primary Examiner* — Andrew M Roersma

(74) *Attorney, Agent, or Firm* — The Dobrusin Law Firm, PC

(57) ABSTRACT

A non-powered cooler system with an integrated powered vacuum sealer wherein the outer body may be made up of a hard casing of hard plastic material or soft waterproof material. A lid for a container includes a frame, the frame removably connected to the container, a lid pivotally connected to the frame, the lid configured to cover and seal an inner volume of the container, a table pivotally connected to the frame, the table having at least one support connected thereto and a vacuum sealer connected to the frame, the vacuum sealer configured to seal food wherein the lid subassembly removable from the container.

6 Claims, 4 Drawing Sheets

(56) References Cited

U.S. PATENT DOCUMENTS

| | | | | |
|---|---|---|---|---|
| 8,371,646 | B1 * | 2/2013 | Sawhney | A47C 11/00 297/141 |
| 9,668,510 | B2 * | 6/2017 | Doman | A23L 3/3418 |
| D835,469 | S | 12/2018 | Lovelace | |
| 10,234,192 | B2 * | 3/2019 | Tang | H04R 1/2807 |
| 10,272,934 | B2 * | 4/2019 | DeFrancia | B62B 1/12 |
| 10,415,868 | B2 * | 9/2019 | Grepper | B01F 7/0025 |
| 2006/0090427 | A1 | 5/2006 | Hau | |
| 2011/0315695 | A1 * | 12/2011 | Fuqua | A45C 11/20 220/592.16 |
| 2016/0166070 | A1 * | 6/2016 | Golic | A47C 9/10 206/216 |
| 2020/0010102 | A1 * | 1/2020 | Mize, Jr. | A45F 3/46 |
| 2020/0017277 | A1 * | 1/2020 | Moon | B65D 81/3818 |

* cited by examiner

COOLER SYSTEM

CROSS REFERENCE TO RELATED APPLICATIONS

This application claims priority and benefit to U.S. provisional application Ser. No. 62/803,429 filed on Feb. 9, 2019.

TECHNICAL FIELD

The present specification generally relates to a cooler system. More specifically, the present specification relates to a cooler system having an integrated vacuum sealer to seal food with an optional foldable table.

BACKGROUND

Coolers are well known in the art. However, typical coolers lack the abilities to process food, such as fish, and store said food in an airtight configuration.

U.S. Pat. No. 5,457,939 discusses a process for vacuum-packaging foodstuffs in rigid containers wherein desired quantity of foodstuff to be packaged is placed in the container, a quantity of aqueous liquid in an amount sufficient to generate, when boiled, a volume of vapor sufficiently in excess of the volume of the container to substantially completely displace all other gases from the container, is added. The container is closed but not sealed, so as to permit communication between the interior of the container and the ambient atmosphere. The container and its contents are warmed to a temperature sufficient to generate the volume of vapor when the container is subjected to a pressure lower than atmospheric pressure. The temperature is kept as low as possible so that no cooking of the foodstuffs occurs. After warming, the containers are exposed to a low pressure so that the liquid in the container boils. The boiling liquid generates vapor in the container sufficient to drive out and displace other gases from the container. The container is hermetically sealed while exposed to the sub-atmospheric pressure.

While the cited prior art discusses the process of vacuum packaging foodstuffs in rigid containers wherein desired quantity of foodstuff to be packaged is placed in the container, a quantity of aqueous liquid in an amount sufficient to generate, when boiled, a volume of vapor sufficiently in excess of the volume of the container to substantially completely displace all other gases from the container, is added. The container is closed but not sealed, so as to permit communication between the interior of the container and the ambient atmosphere. The container and its contents are warmed to a temperature sufficient to generate the volume of vapor when the container is subjected to a pressure lower than atmospheric pressure. The temperature is kept as low as possible so that no cooking of the foodstuffs occurs. After warming, the containers are exposed to a low pressure so that the liquid in the container boils. The boiling liquid generates vapor in the container sufficient to drive out and displace other gases from the container. The container is hermetically sealed while exposed to the sub-atmospheric pressure but the present invention is a a non-powered cooler system with an integrated powered vacuum sealer wherein the outer body may be made up of a hard casing of hard plastic material or soft waterproof material. The cooler system as disclosed in the present invention is portable light weighted and suited to be carried during travels and for the preservation of the perishable material such as food, fish, vegetables, etc.

U.S. Pat. No. 7,930,892 talks about refrigerator with continuous vacuum insulation wherein a refrigerator includes a refrigerator housing, a refrigerated compartment disposed within the refrigerator housing, and a hollow refrigerator wall having insulation material therein. There is a first fluid connection from the vacuum pump to the hollow refrigerator wall for providing a first function of evacuating air from the hollow refrigerator wall and a second fluid connection from the vacuum pump for providing a second function of evacuating air.

While the cited prior art talks about refrigerator with continuous vacuum insulation but the present invention is non-powered cooler system with an integrated powered vacuum sealer wherein the outer body may be made up of a hard casing of hard plastic material or soft waterproof material. The cooler system as disclosed in the present invention is portable light weighted and suited to be carried during travels and for the preservation of the perishable material such as food, fish, vegetables, etc.

U.S. Pat. Application No. US20060090427A1 discusses a refrigerator with integral vacuum sealer wherein a vacuum packaging system that is comprised of a very convenient vacuum pump and canister-sealing device is an integral component of a refrigerator. The device is comprised of: 1) one or more external vacuum hose input ports or retractable combination hose/input ports, for applying a vacuum for packaging canisters, bottles or jars, or a remote bag sealing unit; 2) an internal configuration comprised of one or more vacuum hose input ports or retractable combination hose/input ports, canister lid storage attachments and/or carousel storage attachments; and/or 3) an external, integral or removable bagging unit (recessed into the refrigerator door) for vacuum sealing and cutting plastic bagging material. There exists a need in the art to provide a more cost effective and portable sealing solution.

While the cited prior art talks about refrigerator with integral vacuum sealer but the present invention is a a non-powered cooler system with an integrated powered vacuum sealer wherein the outer body may be made up of a hard casing of hard plastic material or soft waterproof material. The cooler system as disclosed in the present invention is portable light weighted and suited to be carried during travels and for the preservation of the perishable material such as food, fish, vegetables, etc.

SUMMARY

The present invention is a non-powered cooler system with an integrated powered vacuum sealer and table wherein the outer body may be made up of a hard casing of hard plastic material or soft waterproof material. The vacuum sealer is intended to seal bags of food exterior to the cooler, not the cooler itself. The cooler system as disclosed in the present invention is portable light weighted and suited to be carried during travels and for the preservation of the perishable material such as food, fish, vegetables, etc.

A non-powered cooler system having an outer body defining an inner volume, the inner volume adapted to store a quantity of food and a lid subassembly connected to the outer body, the lid subassembly having a frame, the frame removably connected to the outer body, a lid pivotally connected to the frame, the lid configured to cover and seal the inner volume, a table pivotally connected to the frame, the table having at least one support connected thereto and a vacuum sealer connected to the frame, the vacuum sealer configured to seal food, the lid subassembly removable from the outer body. In some embodiments, the lid pivotally connects to the frame on a first edge of the frame and the table pivotally connects to the frame on a second edge, the first edge may be perpendicular to the second edge. The table may include a generally planar upper surface having a distal edge. In some embodiments, the table is supported by at least one leg, the at least one leg positioned at the distal edge of the table. The lid subassembly may further includes an electronics module, the electronics module configured to pivotally connect to the frame, the electronics module configured to cover at least a portion of the inner volume. In some embodiments, the electronics module contains the vacuum sealer.

In other embodiments, a lid is provided to be interchangeable with standard container lids. A lid for a container includes a frame, the frame removably connected to the container, a lid pivotally connected to the frame, the lid configured to cover and seal an inner volume of the container, a table pivotally connected to the frame, the table having at least one support connected thereto and a vacuum sealer connected to the frame, the vacuum sealer configured to seal food wherein the lid subassembly removable from the container.

In some embodiments, the lid pivotally connects to the frame on a first edge of the frame and the table pivotally connects to the frame on a second edge. In some embodiments, the first edge is perpendicular to the second edge. The table may include a generally planar upper surface having a distal edge. In some embodiments, the table is supported by at least one leg, the at least one leg positioned at the distal edge of the table. The lid assembly may further include an electronics module, the electronics module configured to pivotally connect to the frame, the electronics module configured to cover at least a portion of an inner volume of the container. In some embodiments, the electronics module contains the vacuum sealer.

Rotomolding might be used to mold the cooler since rotomolding is known to make the strongest and most durable coolers and can be configured to make detailed angles and compartments such as the one needed to house the vacuum sealer but it might also be made by injection molding or sewing and patching techniques. The vacuum sealer to be integrated will also be designed specifically for this product.

This cooler would be used as storage for cold goods. For example when a fish is caught the top of the cooler will be used to filet the fish. Then directly after, each filet is inserted into a vacuum sealer sleeve or bag and inserted into the opening of the vacuum sealer component built into the cooler then the vacuum sealer sucks out all the air from the inside of the sleeve or bag and in turn seals it. This will ensure the best quality meat possible by vacuum sealing and putting the same in ice right away.

Another advantage of the present invention shall be that it can be used to seal oil waste rags and clean the products in the field before housing them inside the container and until ready for further disposal. It can vary in size as per the requirement.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be understood when read in conjunction with the following drawings, where like structure is indicated with like reference numerals and in which:

DETAILED DESCRIPTION

Figure 1:
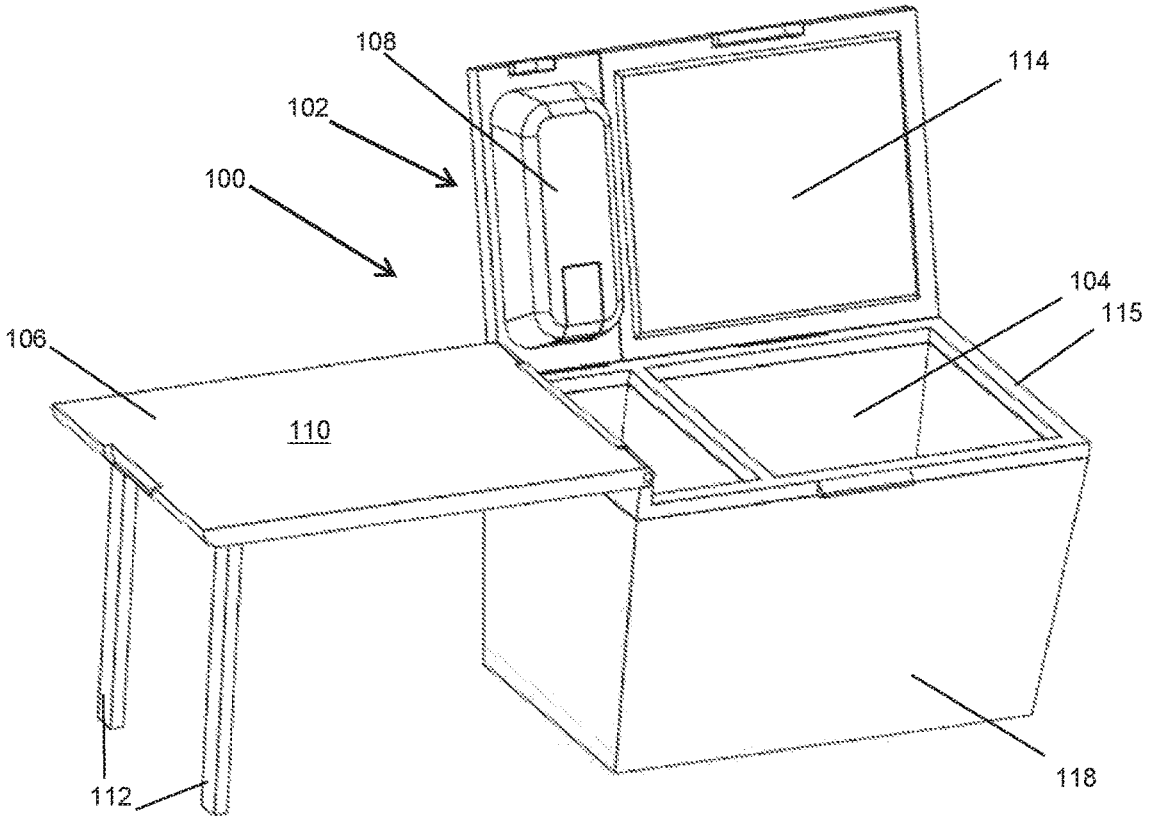
FIG. 1 depicts a perspective view of the cooler open and the table unfolded according to one or more embodiments shown and described herein.
Figure 2:
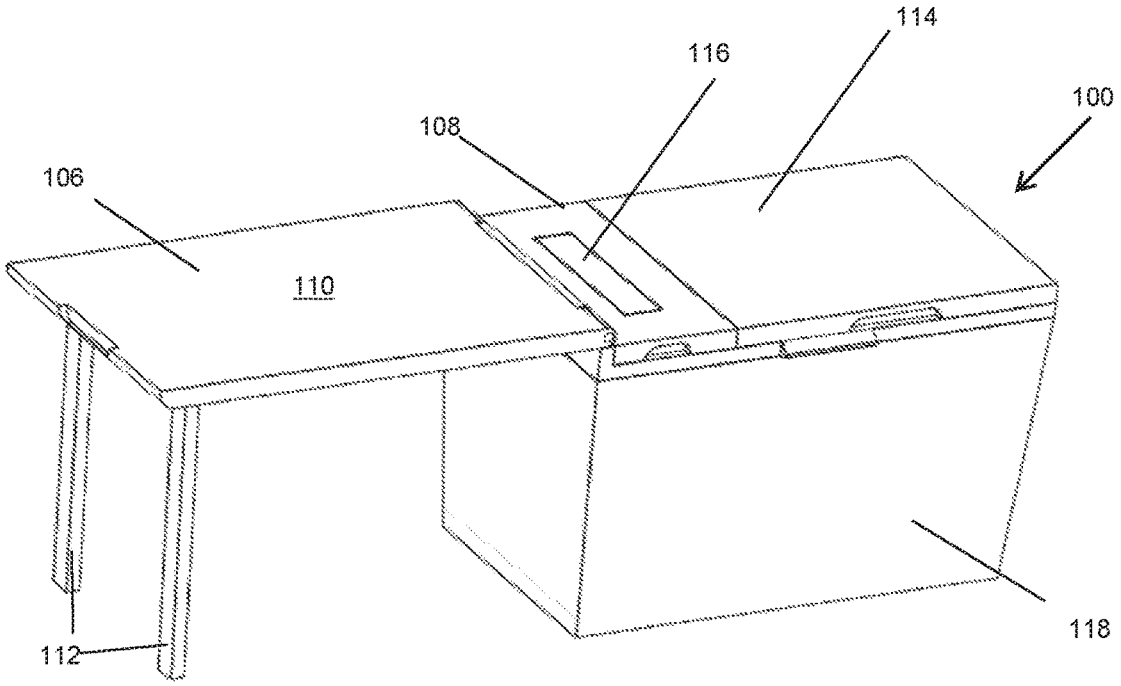
FIG. 2 depicts a perspective view of the cooler closed and the table unfolded according to one or more embodiments shown and described herein.

Referring now to FIG. 1, the cooler assembly 100 includes a lid sub assembly 102 connected thereto. The cooler assembly 100 generally includes a table portion 106 and a cooler portion 104. The cooler portion 104 may be any container or storage assembly or configuration adapted to hold a quantity of food or other items. in the embodiment as shown in the present figures, the cooler portion 104 is adapted to keep a quantity of food cold. However, in other embodiments, the cooler portion 104 may simply be storage to store various items. In the present embodiment, the cooler portion 104 includes a hard outer shell 118. The outer shell 118 may be comprised of a hard plastic or metal material. In other embodiments, the outer shell may be soft and/or pliable. in the present embodiment, the cooler portion 104 includes two separate and distinct storage areas. The storage areas may be kept a different temperatures or be used to hold different types of food or items. The cooler portion 104 includes an upper ring portion configured to connect Directly to an upper peripheral edge of the cooler portion 104. This upper ring is directly connected to the lid sub assembly 102.

Figure 3:
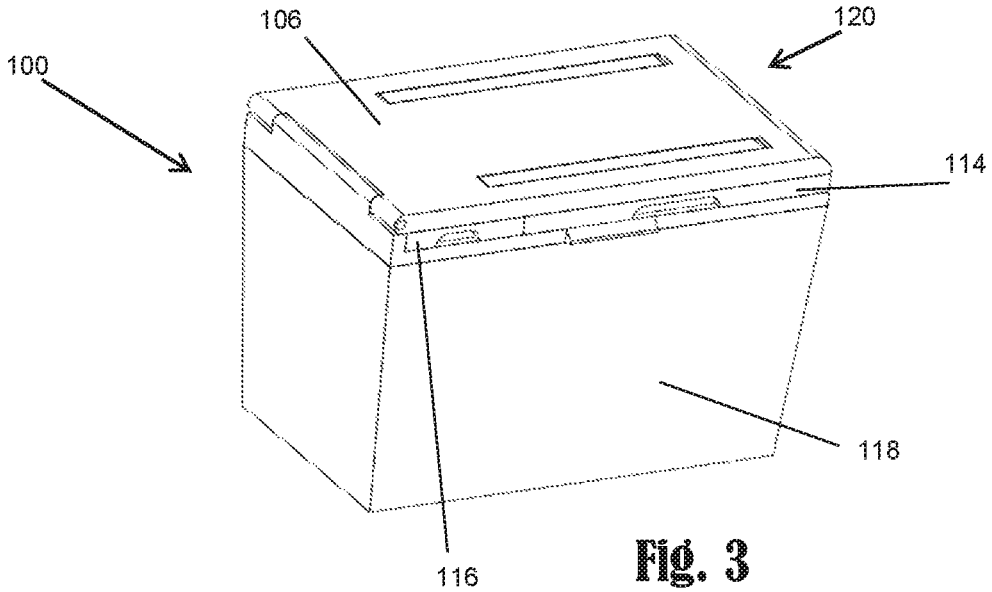
FIG. 3 depicts a perspective view of the cooler closed and the table folded according to one or more embodiments shown and described herein.
Figure 4:
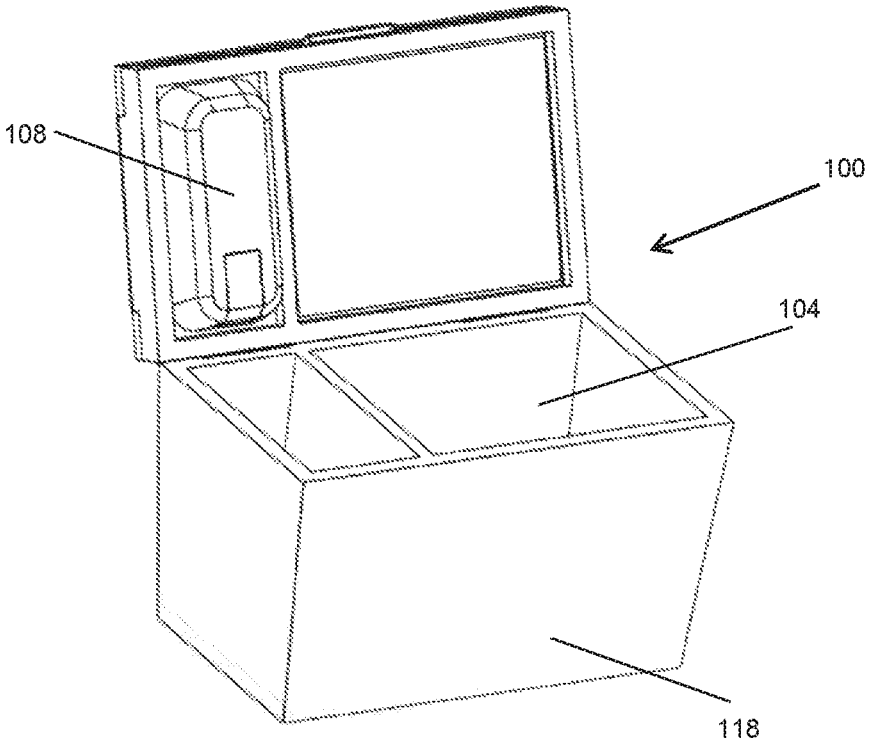
FIG. 4 depicts a perspective view of the cooler open and the table folded according to one or more embodiments shown and described herein.
Figure 5:
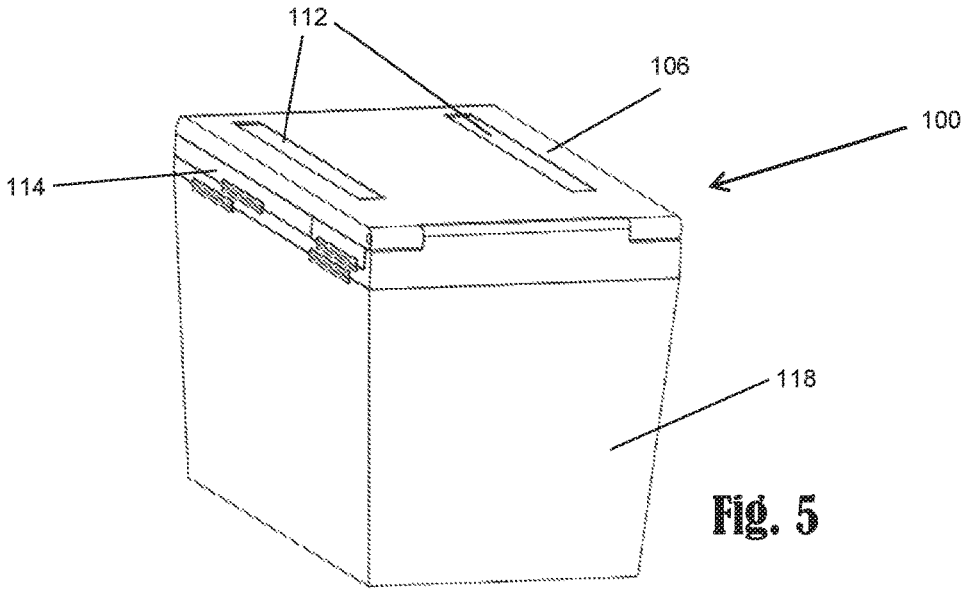
FIG. 5 depicts an alternative perspective view of the cooler open and the table folded according to one or more embodiments shown and described herein.
Figure 6:
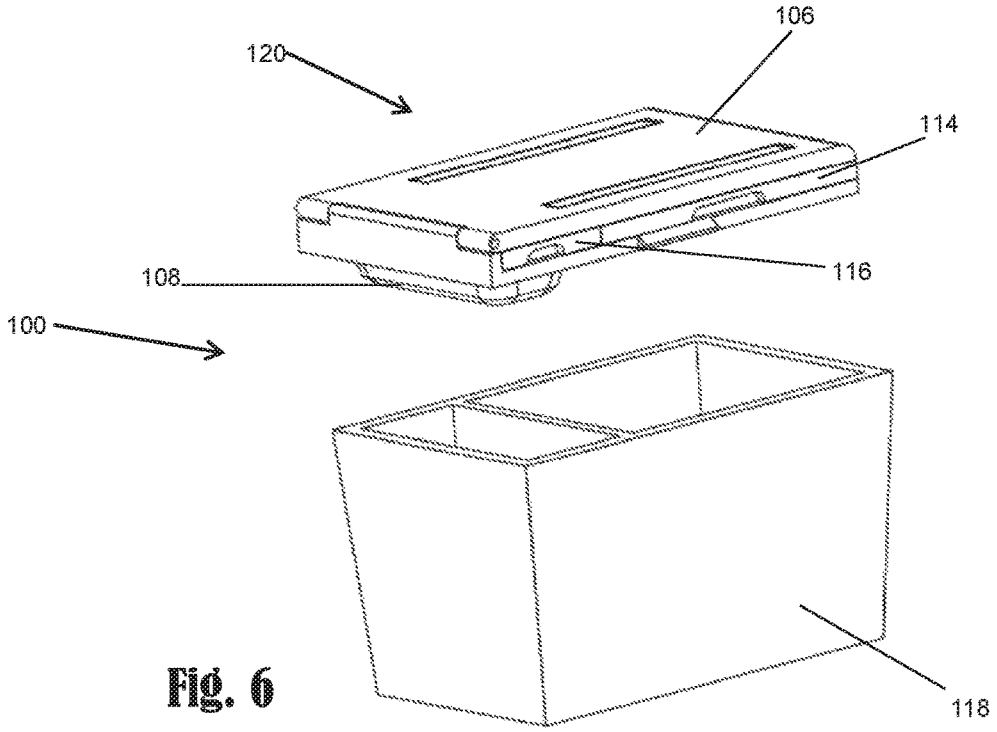
FIG. 6 depicts an exploded perspective view of the cooler with the lid assembly removed according to one or more embodiments shown and described herein.
Figure 7:
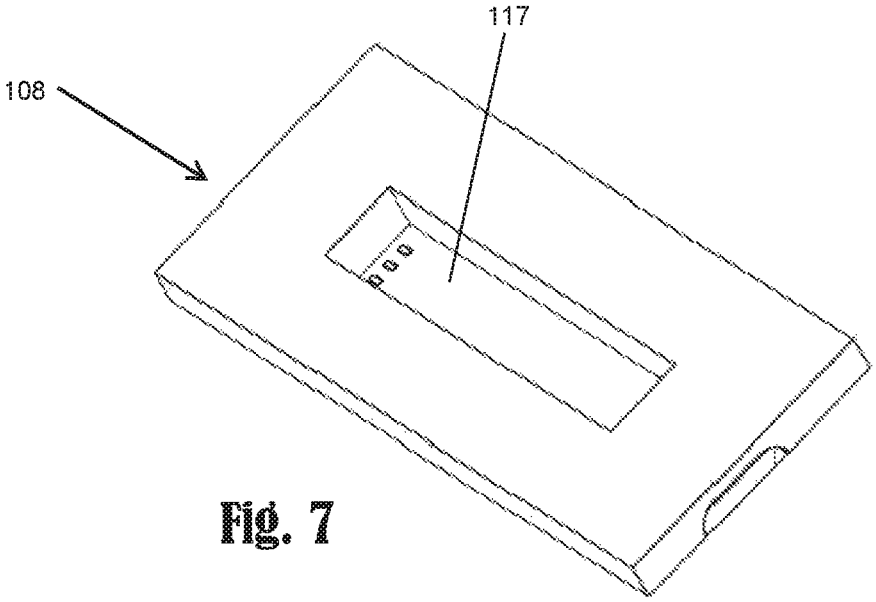
FIG. 7 depicts a perspective view of the sealer portion according to one or more embodiments shown and described herein.
Figure 8:
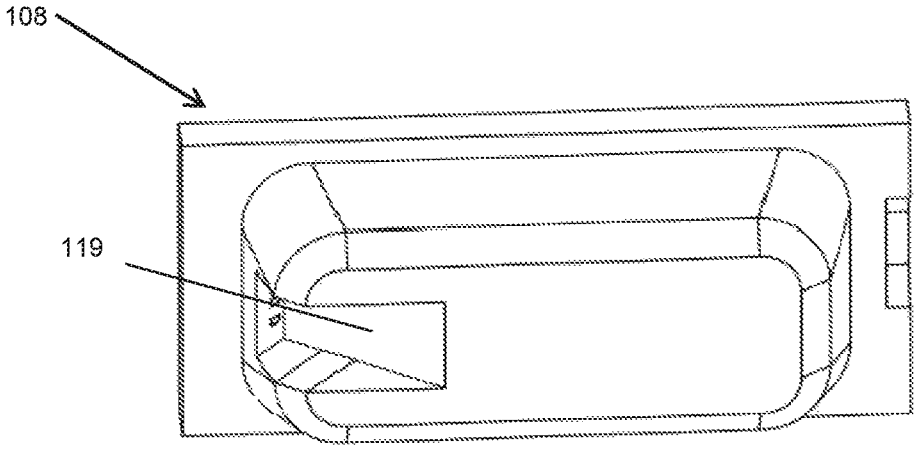
FIG. 8 depicts an alternative perspective view of the sealer portion according to one or more embodiments shown and described herein.

The table portion 106 is pivotally connected to lid sub assembly 102. The table portion 106 is configured to move From a stowed position, such as illustrated in FIGS. 3-5, to a used position such as illustrated in FIG. 1. Table portion 106 includes a generally planer table surface 110 having a plurality of pivotable legs 112. In the present embodiment, the legs 112 are connected by means of a pivotable hinge so as to store in a flat configuration when in the stowed position. When in use, the legs 112 are generally perpendicular to the table surface wanton so as to support the table surface 110 when in use. When the table portion 106 is in the stowed position, the table portion 106 becomes part of the lid and is thus pivotable with the lid subassembly 102 as a whole.

The lid subassembly 102 further includes a lid 114. The lid 114 is configured to close and seal the storage portion of the cooler portion 104. The cooler portion 104 is the area where the user can store food, ice etc. the cooler portion 104 is the area where the user will place ice or food or anything else they want to cool or store. This area may be divided into multiple sections, such as illustrated in the present embodiment, so that there will be divisions for messy items of discarded food or other waste. A handle or a plurality of handles May also be provided on the exterior surface of the cooler at 118.

A frame 115 is provided connected to the outer peripheral edge of the cooling portion 104. The frame 115 is the connection between the cooling portion 104 and all other components of the lid sub assembly 102. The frame 115 is fixedly connected to the lid some assembly 102 and removably connected to the cooler 104. The frame 115 allows the lid sub assembly 102 to be interchangeable or to be placed on a similar size cooler.

The table 106 is pivotally connected to the frame 115. The table 106 may be used for displaying, preparing, packaging, or otherwise manipulating food or beverages. When in a stowed position, the table 106 is positioned above the lid 114, such as illustrated in FIG. 3.

The electronics module 108 is the compartment containing all of the electronica components required for operation of the vacuum sealer 116. The electronics module 108 contains the battery, wires, vacuum sealer 116, USB port etc. and it will also serve as a lid for the small storage compartment located adjacent to the cooler portion 104. The vacuum sealer 116 may be connected to this module but also may be removable for cleaning and/or maintenance purposes. All of the aforementioned components will be securely stowed with a robust and waterproof seal.

The vacuum sealer 116 Is positioned adjacent to the table 106 so the user can prepare or package food and use the table 106 as a support when sealing a bag. By way of example, a user may fillet a fish on the surface 110 of the table 106 and then vacuum seal the fish using the vacuum sealer 116 and then store it in the cooler portion 104. In the table 106, or in the lid 114, there may be additional space to store accessories such as a knife so that a user may have easy access to said accessories.

The electronics module 108 includes a vacuum sealer holder 117 configured to hold the vacuum sealer 116. The electronics module 108 also includes a portion configured to hold a battery at reference numeral 119. For the battery and sealer 116 to be removable and easily connected again, one place on its respective compartments, each will match with terminals contained within the spaces 117, 119.

It is noted that the terms "substantially" and "about" may be utilized herein to represent the inherent degree of uncertainty that may be attributed to any quantitative comparison, value, measurement, or other representation.

These terms are also utilized herein to represent the degree by which a quantitative representation may vary from a stated reference without resulting in a change in the basic function of the subject matter at issue.

While particular embodiments have been illustrated and described herein, it should be understood that various other changes and modifications may be made without departing from the spirit and scope of the claimed subject matter.

Moreover, although various aspects of the claimed subject matter have been described herein, such aspects need not be utilized in combination.

It is therefore intended that the appended claims cover all such changes and modifications that are within the scope of the claimed subject matter.

The invention claimed is:

1. A cooler system comprising:

an outer body defining a first inner volume and a second inner volume, the first inner volume and the second inner volume adapted to store a quantity of food; and a lid subassembly connected to the outer body, the lid subassembly comprising:

a first lid pivotally connected to the outer body, the first lid configured to cover and seal the first inner volume;

a second lid pivotally connected to the outer body, the second lid configured to cover and seal the second inner volume, the second lid having a compartment, the compartment comprising an electronics module having a battery contained therein, and a vacuum sealer removably connected to the electronics module, the vacuum sealer powered by the battery of the electronics module thereby providing for portability, the vacuum sealer configured to seal and package food; and a stowable table, the stowable table having a planar table surface, the planar table surface directly adjacent to an upper surface of the first lid and an upper surface of the second lid when in a stowed position.

2. The cooler system of claim 1, wherein the first lid and the second lid pivotally connect to the outer body on a first edge of the outer body, and the stowable table pivotally connects to the outer body on a second edge of the outer body.

3. The cooler system of claim 2, wherein the first edge is perpendicular to the second edge.

4. A lid assembly for a container having a first inner volume and a second inner volume, the lid assembly comprising:

a first lid, the first lid configured to cover and seal the first inner volume of the container;

a second lid, the second lid configured to cover and seal the second inner volume, the second lid having a compartment, the compartment accessible by an opening on an upper surface of the second lid, the compartment comprising an electronics module having a battery contained therein, and a vacuum sealer powered by the battery, the vacuum sealer removably mounted within the compartment and configured to seal and package food; and a stowable table, the stowable table having a planar table surface, the planar table surface directly adjacent to an upper surface of the first lid and the upper surface of the second lid when in a stowed position.

5. The lid assembly of claim 4, wherein the first lid and the second lid are pivotally connected to a first side of the lid assembly, and the stowable table is pivotally connected to a second side of the lid assembly.

6. The cooler system of claim 5, wherein the first side is perpendicular to the second side.

* * * * *